United States Patent [19]

Cheung

[11] Patent Number: 5,074,898

[45] Date of Patent: Dec. 24, 1991

[54] CRYOGENIC AIR SEPARATION METHOD FOR THE PRODUCTION OF OXYGEN AND MEDIUM PRESSURE NITROGEN

[75] Inventor: Harry Cheung, Buffalo, N.Y.

[73] Assignee: Union Carbide Industrial Gases Technology Corporation, Danbury, Conn.

[21] Appl. No.: 504,630

[22] Filed: Apr. 3, 1990

[51] Int. Cl.[5] ..... F25J 3/00; F25J 3/02

[52] U.S. Cl. ..... 62/38; 62/18; 62/24; 62/25; 62/26; 62/44

[58] Field of Search ..... 62/11, 17, 18, 23, 24, 62/25, 26, 38, 42, 44

[56] References Cited

U.S. PATENT DOCUMENTS

| | | | |
|---|---|---|---|
| 3,203,193 | 8/1965 | Ruheman et al. | 62/13 |
| 3,210,947 | 10/1965 | Dubs et al. | 62/13 |
| 3,217,502 | 11/1965 | Keith, Jr. | 62/13 |
| 3,508,412 | 4/1970 | Yearout | 62/13 |
| 3,736,762 | 6/1973 | Toyama et al. | 62/13 |
| 3,905,201 | 9/1975 | Conevey et al. | 62/38 X |
| 4,224,045 | 9/1980 | Olszewski et al. | 62/38 X |
| 4,400,188 | 8/1983 | Patel et al. | 62/13 |
| 4,416,677 | 11/1983 | Pahade | 62/24 X |
| 4,439,220 | 3/1984 | Olszewski et al. | 62/31 |
| 4,496,383 | 1/1985 | Hubbard et al. | 62/31 |
| 4,555,256 | 11/1985 | Skolaude et al. | 62/38 X |
| 4,560,397 | 12/1985 | Cheung | 62/28 |
| 4,594,085 | 6/1986 | Cheung | 62/25 |
| 4,617,037 | 10/1986 | Okada et al. | 62/11 |
| 4,617,040 | 10/1986 | Yoshino | 62/37 |
| 4,704,148 | 11/1987 | Kleinberg | 62/24 |
| 4,715,874 | 12/1987 | Erickson | 62/38 X |
| 4,775,399 | 10/1988 | Erickson | 62/38 X |
| 4,783,208 | 11/1988 | Rathbone | 62/38 X |
| 4,783,210 | 11/1988 | Ayres et al. | 62/24 |
| 4,806,136 | 2/1989 | Kiersz et al. | 62/18 |
| 4,834,785 | 5/1989 | Ayres | 62/38 |
| 4,848,996 | 7/1989 | Thorogood et al. | 62/39 |
| 4,871,382 | 10/1989 | Thorogood et al. | 62/24 X |
| 4,957,524 | 9/1990 | Pahade et al. | 62/18 |

OTHER PUBLICATIONS

Ayres et al, Developments in Nitrogen Generators, Cryogenic Processes and Equipment, 6/1984, pp.155-163, Dec. 9, 1984.

*Primary Examiner*—Henry A. Bennet
*Assistant Examiner*—Christopher Kilner
*Attorney, Agent, or Firm*—Stanley Ktorides

[57] ABSTRACT

A cryogenic air separation method for the production of oxygen and medium pressure nitrogen comprising a primary higher pressure column and an auxiliary smaller lower pressure stripping column wherein primary column bottom liquid is employed as stripping column downflow liquid and primary column top vapor condenses against stripping column bottom liquid to generate stripping vapor.

9 Claims, 3 Drawing Sheets

CRYOGENIC AIR SEPARATION METHOD FOR THE PRODUCTION OF OXYGEN AND MEDIUM PRESSURE NITROGEN

TECHNICAL FIELD

This invention relates generally to cryogenic air separation and more particularly to the production of nitrogen at elevated pressures. The invention enables the production of significant amounts of oxygen along with the elevated pressure nitrogen.

BACKGROUND ART

High purity nitrogen at medium pressures within the range of from 40 to 95 pounds per square inch absolute (psia) is used for many purposes such as blanketing, stirring, conveying, pressurizing, inerting and purging in many industries such as in the electronics, glass, aluminum and chemical industries. Generally such nitrogen is produced in a single column air separation plant wherein nitrogen is the only product. In some situations it would be desirable to produce commercially usable oxygen along with the nitrogen, for example for use in oxygen or oxygen-enriched air combustion.

The production of oxygen and nitrogen by cryogenic air separation has long been known by use of a double column plant wherein a larger lower pressure column is in heat exchange relation with a smaller higher pressure column. Unfortunately such a conventional double column produces nitrogen at only a few pounds per square inch greater than atmospheric pressure. This necessitates costly compression of the nitrogen to achieve the desired higher pressure.

There are known cryogenic air separation methods which can produce medium pressure nitrogen and small amounts of very high purity oxygen. Such methods are disclosed in U.S. Pat. No. 4,560,397—Cheung and U.S. Pat. No. 4,783,210—Ayres et al. However, such methods can produce only a small amount of oxygen and thus their utility is limited when significant quantities of commercially usable oxygen are required.

Accordingly it is an object of this invention to provide a cryogenic air separation method which can produce nitrogen at elevated pressure and can also produce significant quantities of commercially usable oxygen.

SUMMARY OF THE INVENTION

The above and other objects which will become apparent to one skilled in the art upon a reading of this disclosure are attained by:

A cryogenic air separation method for the production of nitrogen at elevated pressure and oxygen comprising:

(A) providing feed air into a primary column operating at a pressure within the range of from 40 to 95 psia and separating feed air in the primary column into nitrogen-rich vapor and oxygen-enriched liquid;

(B) passing oxygen-enriched liquid into an auxiliary stripping column at the top of the stripping column which is operating at a pressure less than that of the primary column and has fewer equilibrium stages than the primary column;

(C) passing oxygen-enriched liquid down the stripping column against upflowing vapor to produce oxygen-rich liquid;

(D) recovering a first portion of the nitrogen-rich vapor as Product elevated pressure nitrogen;

(E) condensing a second portion of the nitrogen-rich vapor by indirect heat exchange with oxygen-rich liquid to produce oxygen-rich vapor;

(F) passing oxygen-rich vapor up the stripping column as the upflowing vapor; and (G) recovering a portion of the oxygen-rich vapor as product oxygen.

The term, "column", as used herein means a distillation or fractionation column or zone, i.e., a contacting column or zone wherein liquid and vapor phases are countercurrently contacted to effect separation of a fluid mixture, as for example, by contacting of the vapor and liquid phases on a series or vertically spaced trays or plates mounted within the column or alternatively, on packing elements with which the column is filled. For a further discussion of distillation columns see the Chemical Engineers' Handbook. Fifth Edition, edited by R. H. Perry and C. H. Chilton, McGraw-Hill Book Company, New York, Section 13, "Distillation" B. D. Smith et al, page 13-3, *The Continuous Distillation Process.* The term, double column is used to mean a higher pressure column having its upper end in heat exchange relation with the lower end of a larger lower pressure column. A further discussion of double columns appears in Ruheman "The Separation of Gases" Oxford University Press, 1949, Chapter VII, Commercial Air Separation. Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Distillation is the separation process whereby heating of a liquid mixture can be used to concentrate the volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns.

The term "indirect heat exchange", as used herein means the bringing of two fluid streams into heat exchange relation without any physical contact intermixing of the fluids with each other.

As used herein, the term "tray" means a contacting stage, which is not necessarily an equilibrium stage, and may mean other contacting apparatus such as packing having a separation capability equivalent to one tray.

As used herein, the term "equilibrium stage" means a vapor-liquid contacting stage whereby the vapor and liquid leaving the stage are in mass transfer equilibrium, e.g. a tray having 100 percent efficiency or a packing element equivalent to one height equivalent of a theoretical plate (HETP).

DETAILED DESCRIPTION

The invention will be described in detail with reference to the Drawings.

Figure 1:
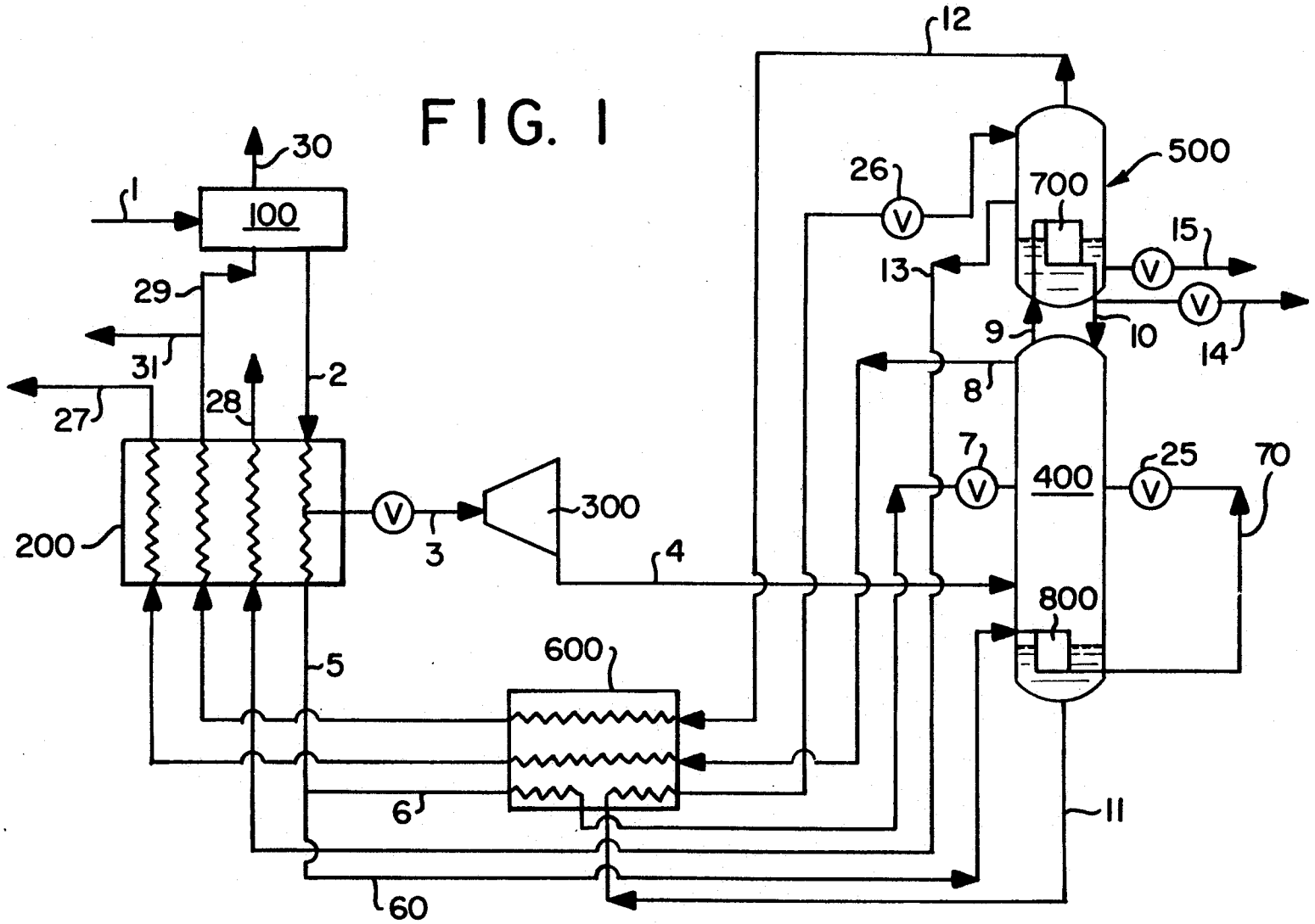
FIG. 1 is a schematic representation of one preferred embodiment of the cryogenic air separation method of this invention.

Referring now to FIG. 1, compressed feed air 1 is passed through zeolite molecular sieve adsorption prepurifier 100 wherein impurities such as water vapor, carbon dioxide and acetylene are removed. A prepurifier is preferred over, for example, a reversing heat exchanger, for cleaning the feed air. Clean compressed feed air 2 is then cooled by indirect heat exchange in heat exchanger 200 against return streams as will be more fully described below. The feed air is divided into a major portion 3 which comprises from 55 to 99 percent, preferably from 65 to 85 percent of the feed air, and into a minor portion 5 which comprises from 1 to 45 percent, preferably from 15 to 35 percent of the feed air. Major portion 3 is turboexpanded through turboexpander 300 to generate refrigeration and the expanded stream 4 is provided into primary column 400 operating at a pressure within the range of from 40 to 95, preferably 45 to 85, psia. Below the lower pressure range limit the requisite heat exchange will not work effectively and above the upper pressure range limit, stream 60 to reboiler 800 will require excessive pressure. Minor portion 5 can be divided into smaller portion 6 which is condensed by indirect heat exchange through heat exchanger or superheater 600, expanded through valve 7 and introduced into column 400, and into larger portion 60 which is condensed by indirect heat exchange in heat exchanger or reboiler 800 against column 400 bottoms. Smaller portion 6 comprises from 1 to 20 percent of minor portion 5 and larger portion 60 comprises from 80 to 99 percent of minor portion 5. The condensation of larger portion 60 in reboiler 800 provides vapor upflow to column 400 and the resulting condensed stream 70 is expanded through valve 25 and passed into column 400. In order to carry out the requisite heat exchange, reboiler or heat exchanger 800 operates at a higher pressure than that at which primary column 400 is operating. Generally the pressure of larger portion 60 passing through reboiler 800 will be from 10 to 90, preferably from 15 to 60, psi above that pressure at which primary column 400 is operating. FIG. 1 illustrates a preferred way to achieve this pressure differential wherein the entire feed air stream is first compressed and then the major portion is turboexpanded to provide plant refrigeration prior to introduction into primary column 400. Alternatively, only the minor portion of the feed air could be compressed to the requisite pressure exceeding the column operating pressure.

Within primary column 400 the feed air is separated by cryogenic rectification into nitrogen-rich vapor and oxygen-enriched liquid. Oxygen-enriched liquid is passed 11 from primary column 400, subcooled through heat exchanger 600, passed through valve 26, and passed into auxiliary stripping column 500 at the top of the column. By "at the top" it is meant at or near the top such that the liquid may pass through substantially all of the equilibrium stages of column 500. Auxiliary stripping column 500 operates at a pressure less than that at which primary column 400 is operating. Generally the operating pressure of stripping column 500 will be within the range of from 15 to 50 psia. Stripping column 500 has fewer equilibrium stages than does primary column 400. Preferably stripping column 500 has one third or less of the number of equilibrium stages of primary column 400. Typically, primary column 400 will have from 35 to 55 equilibrium stages and stripping column 500 will have from 2 to 15 equilibrium stages.

Oxygen-enriched liquid is passed down stripping column 500 against upflowing vapor which serves to strip nitrogen out of the downflowing liquid thus producing oxygen-rich liquid at the bottom of the column.

A first portion 8 of the nitrogen-rich vapor is passed from column 400, heated through heat exchangers 600 and 200 and recovered as medium pressure nitrogen product 27 at a pressure within the range of from 40 to 95 psia. A second portion 9 of the nitrogen-rich vapor is passed from column 400 to reboiler or heat exchanger 700 wherein it condenses by indirect heat exchange with oxygen-rich liquid to produce upflowing vapor for stripping column 500. This heat exchange preferably occurs inside the stripping column as illustrated in FIG. 1 but it may also occur outside the column. Resulting condensed nitrogen stream 10 is returned to primary column 400 as liquid reflux for column 400. If desired, a portion 14 of liquid stream 10 may be recovered as product liquid nitrogen. First portion 8 and second portion 9 together make up substantially the entire amount of nitrogen-rich vapor produced in primary column 400. That is, there is no need to recycle any portion of stream 8 back to the column system and the entire amount of stream 8 may be recovered as product 27.

If desired, a portion 15 of the oxygen-rich liquid may be recovered as product liquid oxygen. As mentioned, the oxygen-rich liquid is boiled by indirect heat exchange with the second portion of the nitrogen-rich vapor to produce oxygen-rich vapor for column 500 vapor upflow. A portion 13 of the oxygen-rich vapor is passed from column 500, heated through heat exchanger 200 and recovered as product oxygen 28. The stripping vapor is removed from the top of column 500 as stream 12 and warmed by passage through heat exchangers 600 and 200. A portion 29 may be used to regenerate zeolite molecular sieve adsorbent in prepurifier 100 and then released 30 to the atmosphere along with the other portion 31.

By use of the method of this invention one can produce high purity nitrogen at an elevated or medium pressure within the range of from 40 to 95 psia along with significant amounts of oxygen. The product nitrogen can be produced at a purity of at least 98 mole percent and can have a purity up to 99.99999 mole percent. The product oxygen can have a purity of from 70 to 99.5 mole percent. The product nitrogen is recovered at high yield. Generally the product nitrogen, i.e. the nitrogen recovered in stream 27 and in stream 14 if employed, will be at least 45 percent of the nitrogen introduced into the primary column with the feed air. The sum of these nitrogen products and the oxygen products in streams 28 and 15 if employed will be at least 50 percent of the feed air introduced into the primary column. In general the quantity of medium pressure nitrogen product will exceed the quantity of lower pressure oxygen product by at least a factor of two.

Figure 3:
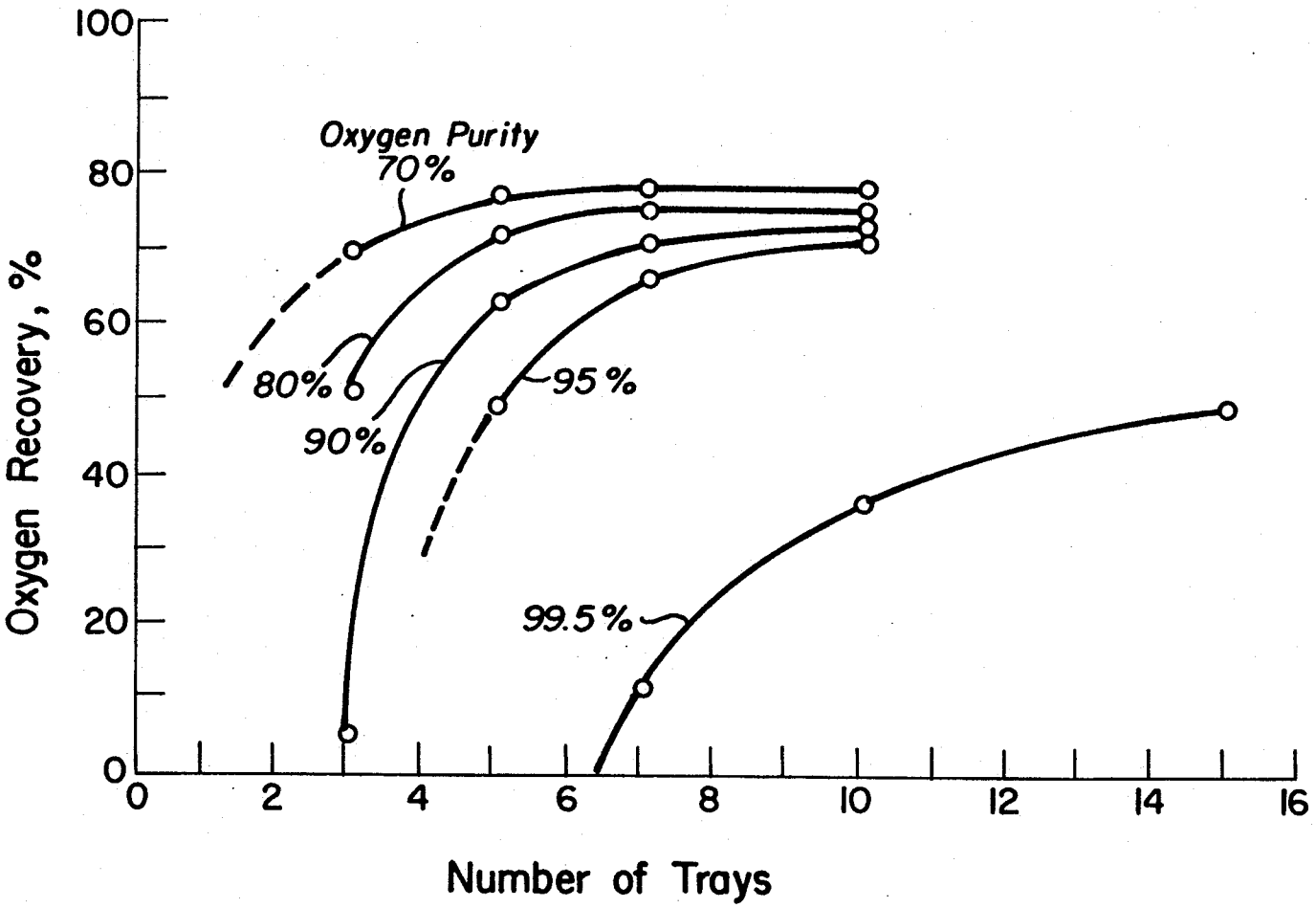
FIG. 3 is a graphical representation of oxygen recoveries attainable with the cryogenic air separation method of this invention.

The degree of oxygen recovery will depend, inter alia, upon the desired purity of the oxygen and the number of trays in the stripping column. For example, with a stripping column having 10 trays oxygen with a purity of 99.5 percent is produced with a recovery of 37 percent while oxygen with a purity of 70 percent is produced with a recovery of 78 percent. FIG. 3 presents some generalized graphical relationships of oxygen recovery, oxygen purity, and number of stripping column trays operating at low pressure for the embodiment of the invention illustrated in FIG. 1.

Figure 2:
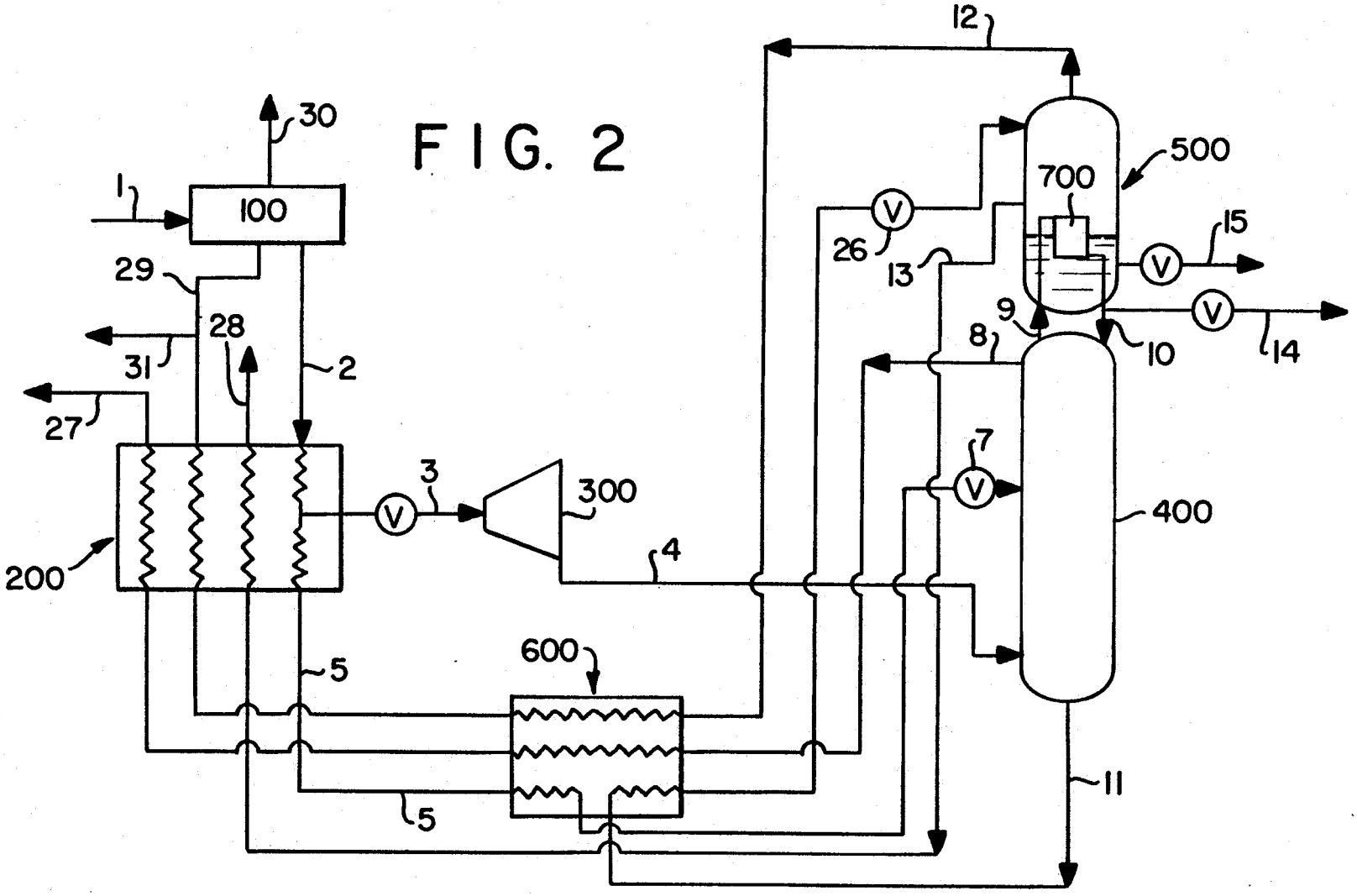
FIG. 2 is a schematic representation of another embodiment of the cryogenic air separation method of this invention.

FIG. 2 illustrates another embodiment of the method of this invention. With the embodiment illustrated in FIG. 2 the quantity of medium pressure nitrogen product is reduced. However a greater amount of refrigeration is provided so that more liquid nitrogen in stream 14 and/or more liquid oxygen in stream 15 may be recovered if desired. The numerals in FIG. 2 correspond to those of FIG. 1 for the common elements and these common elements will not be described again. The embodiment illustrated in FIG. 2 differs from the embodiment illustrated in FIG. 1 in that there is no reboiler at the bottom of the primary column. Minor portion 5 of the feed air is not further divided. Rather the entire minor portion 5 is passed through heat exchanger 600, expanded through valve 7 and passed into primary column 400.

Table I contains a summary of a calculated example of the method of this invention carried out with the embodiment illustrated in FIG. 1. In the calculated example the primary column has 43 theoretical trays and the stripping column has 3 theoretical trays. The stream numbers in Table I correspond to those of FIG. 1 for conditions entering and leaving the column system. The calculated example is presented for illustrative purposes and is not intended to be limiting. In the calculated example the product nitrogen equals 51.2 percent of the feed air and the sum of the product oxygen and product nitrogen equals 72.1 percent of the feed air.

TABLE I

| Stream No. | Temp. (°K.) | Pressure (PSIA) | Flowrate (MCFH) | Composition (mole percent) Nitrogen | Oxygen | Argon |
|---|---|---|---|---|---|---|
| 4 | 98.1 | 58.7 | 241,390 | | | |
| 6 | 93.2 | 58.3 | 7,090 | | | |
| 70 | 93.2 | 58.3 | 45,000 | | | |
| 12 | 86.6 | 17.3 | 82,037 | 75.74 | 22.82 | 1.44 |
| 13 | 89.6 | 17.5 | 61,331 | 27.58 | 70.00 | 2.42 |
| 8 | 90.8 | 56.1 | 150,650 | 99.9+ | — | — |

Although the invention has been described in detail with reference to certain specific embodiments, those skilled in the art will recognize that there are other embodiments of the invention within the spirit and scope of the claims.

I claim:

1. A cryogenic air separation method for the production of nitrogen at elevated pressure and oxygen comprising:

(a) providing feed air into a primary column operating at a pressure within the range of from 40 to 95 psia and separating feed air in the primary column into nitrogen-rich vapor and oxygen-enriched liquid;

(B) passing oxygen-enriched liquid into an auxiliary stripping column at the top of the stripping column which is operating at a pressure less than that of the primary column and which has one third or less equilibrium stages than the primary column;

(C) passing oxygen-enriched liquid down the stripping column against upflowing vapor to produce oxygen-rich liquid;

(D) recovering a first portion of the nitrogen-rich vapor as product elevated pressure nitrogen;

(E) condensing a second portion of the nitrogen-rich vapor by indirect heat exchange with oxygen-rich liquid to produce oxygen-rich vapor;

(F) passing oxygen-rich vapor up the stripping column as the upflowing vapor; and (G) recovering a portion of the oxygen-rich vapor as product oxygen, said oxygen-rich vapor portion taken from the stripping column at a point below the point where oxygen-enriched liquid is passed into the stripping column.

2. The method of claim 1 wherein the feed air is divided into a major portion and a minor portion, and the major portion is turboexpanded prior to introduction into the primary column.

3. The method of claim 2 wherein the major portion comprises from 55 to 99 percent of the feed air.

4. The method of claim 2 wherein some of the minor portion is condensed by indirect heat exchange against boiling oxygen-enriched liquid and then passed into the primary column.

5. The method of claim 1 further comprising recovering a portion of the condensed second portion of the nitrogen-rich vapor as product liquid nitrogen.

6. The method of claim 1 further comprising recovering a portion of the oxygen-rich liquid as product liquid oxygen.

7. The method of claim 1 further comprising cleaning the feed air by passage through a zeolite molecular sieve adsorbent bed.

8. The method of claim 7 further comprising passing vapor from the auxiliary stripping column through the adsorbent bed to regenerate the adsorbent.

9. The method of claim 1 wherein product nitrogen is recovered at a pressure within the range of from 40 to 95 psia and the combined recovery of oxygen and nitrogen product is at least 50 percent of the feed air introduced into the primary column.

* * * * *